US010906706B2

(12) United States Patent
Nilsson et al.

(10) Patent No.: US 10,906,706 B2
(45) Date of Patent: Feb. 2, 2021

(54) CONTAINER AND STORAGE SYSTEM

(71) Applicant: Elfa International AB, Västervik (SE)

(72) Inventors: Peter Nilsson, Västervik (SE); Lars Ryden, Västervik (SE)

(73) Assignee: Elfa International AB, Vastervik (SE)

( * ) Notice: Subject to any disclaimer, the term of this patent is extended or adjusted under 35 U.S.C. 154(b) by 605 days.

(21) Appl. No.: 15/309,111

(22) PCT Filed: May 12, 2015

(86) PCT No.: PCT/EP2015/060429
§ 371 (c)(1),
(2) Date: Nov. 4, 2016

(87) PCT Pub. No.: WO2015/173216
PCT Pub. Date: Nov. 19, 2015

(65) Prior Publication Data

US 2017/0066566 A1 Mar. 9, 2017

(30) Foreign Application Priority Data

May 14, 2014 (EP) ..... 14168245

(51) Int. Cl.
*B65D 43/02* (2006.01)
*B65D 1/34* (2006.01)
(Continued)

(52) U.S. Cl.
CPC ..... *B65D 43/0212* (2013.01); *A47B 67/04* (2013.01); *A47B 88/407* (2017.01);
(Continued)

(58) Field of Classification Search
CPC ..... A47B 2210/0062; A47B 2210/08; A47B 67/04; A47B 88/407; A47B 88/483;
(Continued)

(56) References Cited

U.S. PATENT DOCUMENTS 3,484,035 A 12/1969 Swett et al.
3,552,634 A * 1/1971 Ollier ..... B65D 51/185 229/123.1
(Continued)

FOREIGN PATENT DOCUMENTS

WO WO2010/121295 A1 10/2010

OTHER PUBLICATIONS

International Searching Authority, International Search Report and Written Opinion, International Application No. PCT/EP2015/060429, dated Jun. 11, 2015 (mailing date).

*Primary Examiner* — James N Smalley
*Assistant Examiner* — Madison L Poos
(74) *Attorney, Agent, or Firm* — Hubbard Johnston PLLC

(57) ABSTRACT

A plastic container comprising a box and a lid. The box has a bottom portion and first and second pairs of opposing walls rising from the bottom portion to define an internal space of the container, and the upper edges of the walls are adapted to support the lid and comprise a flanges that extend outwards from the inner space. The lid is adapted to leave an outer portion of said flanges free along the entire length of the walls of the first pair when the lid is applied to the box. The lid can optionally be removed, even if the box is inserted in a rack where the flanges are supported by a guide.

8 Claims, 4 Drawing Sheets

(51) Int. Cl.

| | |
|---|---|
| ***A47B 67/04*** | (2006.01) |
| ***A47B 88/483*** | (2017.01) |
| ***A47B 88/906*** | (2017.01) |
| ***A47B 88/407*** | (2017.01) |
| ***B65D 1/42*** | (2006.01) |
| *A47B 88/919* | (2017.01) |

(52) U.S. Cl.
CPC ..... *A47B 88/483* (2017.01); *A47B 88/906* (2017.01); *B65D 1/34* (2013.01); *B65D 1/42* (2013.01); *B65D 43/0214* (2013.01); *A47B 88/919* (2017.01); *A47B 2210/0062* (2013.01); *A47B 2210/08* (2013.01); *B65D 2543/00194* (2013.01); *B65D 2543/00574* (2013.01)

(58) Field of Classification Search
CPC ..... A47B 88/906; A47B 88/919; A47J 27/10; B65D 1/34; B65D 1/42; B65D 2543/00194; B65D 2543/00574; B65D 43/0212; B65D 43/0214
USPC ..... 220/23.83, 485
See application file for complete search history.

(56) References Cited

U.S. PATENT DOCUMENTS

| | | | | |
|---|---|---|---|---|
| 8,006,858 | B2 * | 8/2011 | Cheng | A47B 55/02 220/485 |
| 2007/0187277 | A1 * | 8/2007 | Furlong | B65D 21/022 206/515 |
| 2013/0063012 | A1 | 3/2013 | Lu | |

* cited by examiner

CONTAINER AND STORAGE SYSTEM

CROSS-REFERENCE TO RELATED APPLICATIONS

The present application is a nationalization of PCT International Application No. PCT/EP2015/060429, International Filing Date 12 May 2015, which claims priority to European Patent Application No. EP14168245.0, filed 14 May 2014, both of which are incorporated herein by reference for all purposes.

The following co-pending and co-assigned applications contain related information: U.S. Nonprovisional patent application Ser. No. 15/309,100 for A Lid and a Storage System, filed concurrently herewith, now abandoned; and U.S. Nonprovisional patent application Ser. No. 15/309,107, for Storage System, filed concurrently herewith, now U.S. Pat. No. 10,028,582.

TECHNICAL FIELD

The present invention relates in general to storage systems, and in particular to modular storage systems including drawer frames and containers.

BACKGROUND

Containers are available in many different formats and may be used for storing various objects. One problem associated with such containers is how to make them suitable for storing in racks of the kind used to support e.g. a number of baskets made of metal wire and mesh materials.

SUMMARY

One object of the present disclosure is therefore to provide a container that is more useful in a rack system. More specifically, a container is disclosed that comprises a lid that is adapted to leave an outer portion of the container flanges free along the entire length of the walls of the first pair when the lid is applied to the box.

This means that the lid can be taken off if desired, even if the flanges are inserted in e.g. U-shaped guides of a rack system. Further, as the flanges can take up the entire height of such a guide, not having to leave room for a lid, flanges can be made more robust, which allows the container to be more heavily loaded without being substantially deformed.

The flanges may extend around corners of the box and along at least a portion of the respective upper edges of the second pair of walls that adjoin the edges of the first pair of walls. This may in many cases be enough to obtain a sufficiently stiff flange construction. Alternatively, the flanges may extend around the entire periphery of the box, thereby forming a single flange.

The lid may reach out over the width of the flange at the edge of the walls in the second pair, at least along a part of the length thereof. This provides additional support for the lid, and does not disturb the interaction between guides and the flanges at the first pair of walls.

The flanges may comprise at least one reinforcing subflange, extending from the flange along at least a part thereof and being directed towards a plane in which the bottom portion extends. This provides a stiffer flange which may nevertheless be injection molded with a relatively thin goods structure. Two parallel subflanges may be provided together with a plurality of lateral reinforcement flanges running perpendicularly to the reinforcement flanges and connecting the reinforcement flanges to each other and to the walls of the box.

An outer subflange may be located at the end of a flange as seen from the interior of the container, and an inner subflanges may be located at a distance a from a wall of the container and at a distance b from the outer flange. The ratio (a+b)/a, between the sum of the c-c distance a between the wall and the inner flange and the c-c distance b between the inner reinforcement flange and the outer reinforcement flange to the c-c distance a between the wall and the inner flange, may be in the range between 1.5 and 1.9. This has shown to provide a very stiff box for a given goods thickness.

The lid may be adapted to, when attached to the box, reach out past the periphery of the walls in the second set along a portion thereof to provide a snap lock function.

The outer portion of the flanges left free may be at least 7 mm.

A storage system including a combination of a container and a drawer frame is also considered.

DETAILED DESCRIPTION

The present disclosure is related to modular storage systems including drawer frames and containers. Such systems have the benefit, e.g. as compared with a traditional chests of drawers, of being configurable in various ways to address the needs of an end user. Drawer frames with metal wire and mesh baskets have been widely appreciated by users that have been able to select wire and mesh baskets with different sizes according to their needs.

From a producer point of view, the components involved have allowed for efficient distribution as empty containers can be nested inside other empty containers and since drawer frames can easily be assembled by the end user. This of course reduces the cost of the final system.

It is suggested to include plastic containers with lids in storage systems of this kind as a complement to wire and mesh containers. This would make storage systems of this kind even more versatile.

Plastic containers are relatively inexpensive to produce in large series by injection molding. Unlike a mesh or wire container, a plastic container may be made diffusion tight, and when lids are attached to the containers, the they become stackable, such that a number of containers, with items stored inside, can be stored on a small floor surface. If the storage system is used for instance in a closet, this allows the user e.g. to switch the contents of the closet from season to season.

For instance, during off-season, winter clothes may be stored at another location and, thanks to the more or less diffusion tight properties of the containers, are protected from moisture, etc. When the clothes are needed again, these containers may replace others in the drawer frame. Such a procedure is much more efficient than moving clothes from a drawer to another box, back and forth. The present disclosure provides solutions that make a plastic container more suitable for a storage system of this kind, thereby contributing to accomplishing the goal of obtaining a more efficient and versatile storage system.

Figure 1:
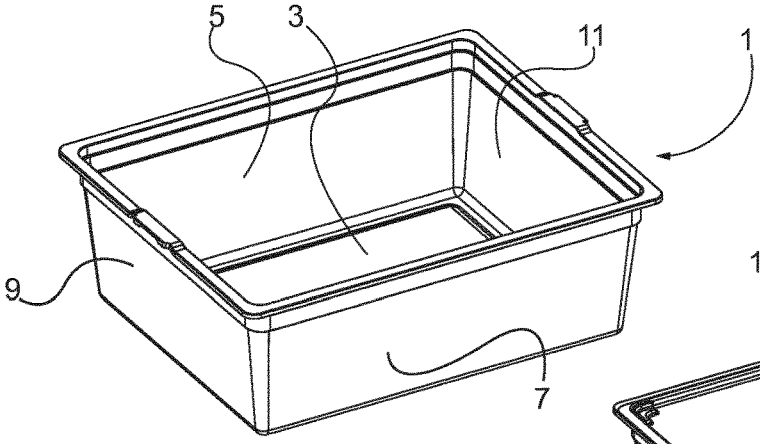
FIG. 1 shows a perspective view of an open container in the form of a box.

The present disclosure relates to a plastic container and further to a combination of a plastic container and a drawer frame. An open plastic container 1 in the form of a box is shown in FIG. 1. The box has a bottom portion 3 and first 5, 7 and second 9, 11 pairs of opposing walls rising from the bottom, thereby defining an internal space of the box.

Figure 2:
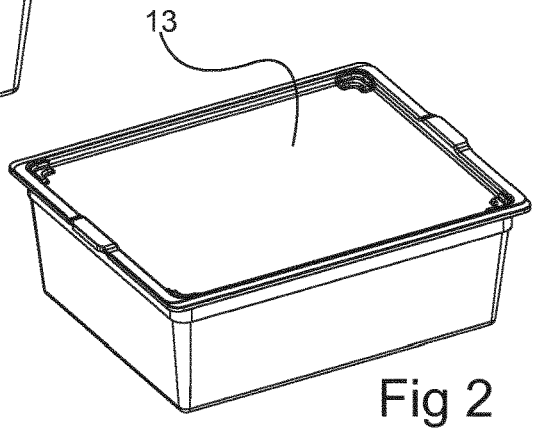
FIG. 2 shows the box with an applied lid.

In FIG. 2 the box 1 with an applied lid 13 is shown, the lid and box together forming a closed container. The upper edges of the box walls 5, 7, 9, 11 support the lid 13.

The box further has suspension flanges, as will be shown, at the upper edges of at least one pair of walls. The flanges extend outwards from the interior of the box in a direction substantially parallel or close to parallel with the plane in which the bottom portion 3 extends. This allows the box to be inserted in a drawer frame.

Figure 4:
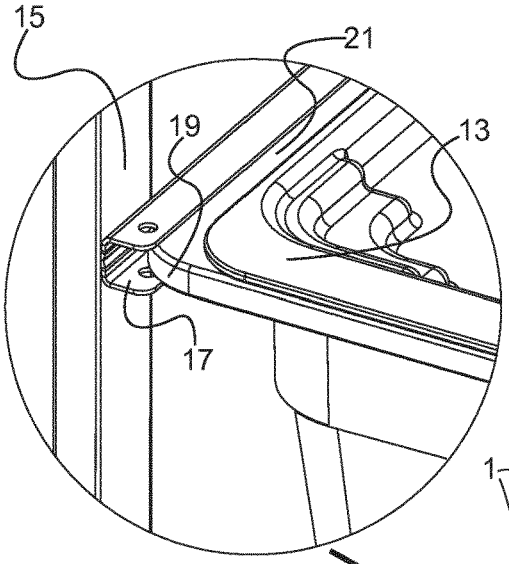
FIG. 4 shows an enlarged portion of FIG. 3.
Figure 3:
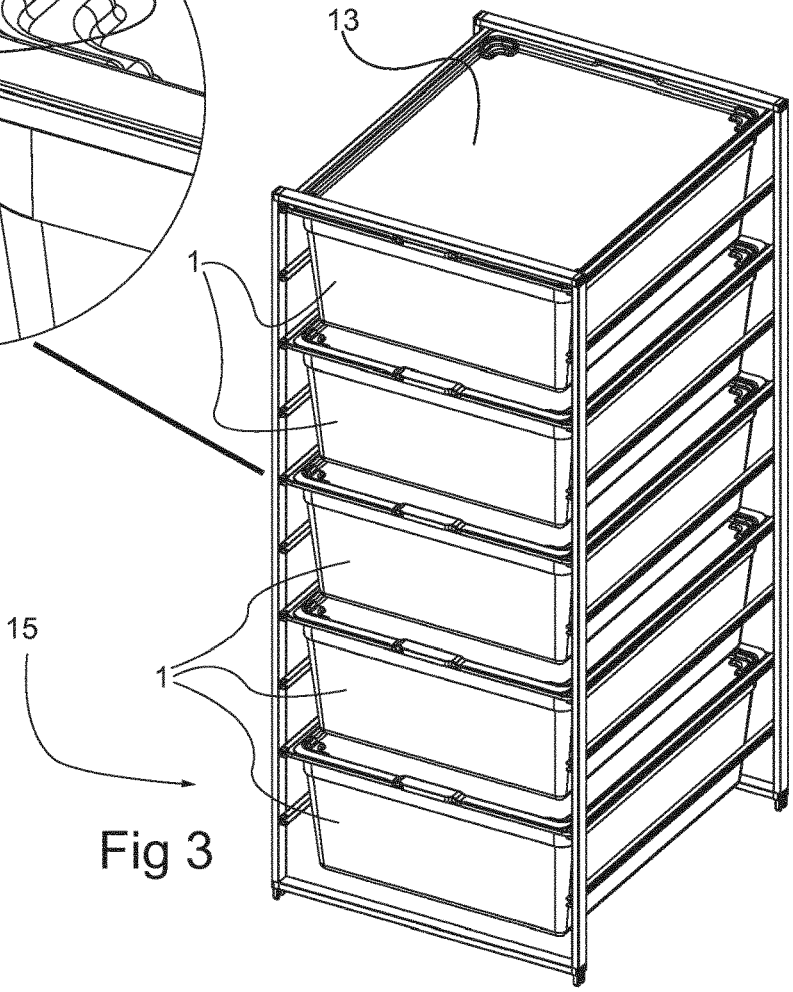
FIG. 3 illustrates a number of containers arranged in a drawer frame.

Such a drawer frame 15 is shown in FIG. 3, where five boxes 1 with applied lids 13 are inserted in the frame. FIG. 4 shows a U shaped guide 17 in the frame, which is adapted to accommodate the flange 19 of the box, in order to support the box in the frame. Such frames with guides are well known per se to support containers made of metal wire, metal mesh materials etc.

As illustrated in FIG. 4, the lid 13 of the box is designed to leave an outer portion 21 of the flange 19 free when the lid is applied to the box. This is done along the length flange that engages with the guide 17 in the drawer frame 15. Thus, for instance in the box shown in FIG. 2, a portion of the flange is left free along the longer sides of the box, although other variations exist as will be discussed. The outer portion 21 of the flanges left free may be at least 7 mm, and about 12 mm is considered suitable for many applications.

As the outer portion 21 of the flange 19 is left free, the flange is allowed to take up almost the entire height of the guide 17, which means that a stiffer flange can be provided for a given guide dimension. A stiff flange is advantageous as it allows the box to be more heavily loaded without bulging, as will be discussed later.

Additionally, the lid can in many cases be removed without taking the box 1 out of the drawer frame 15. For instance, if no box is inserted in the middle compartment of the drawer frame in FIG. 3, the lid of the box below the middle compartment can easily be removed.

Figure 5:
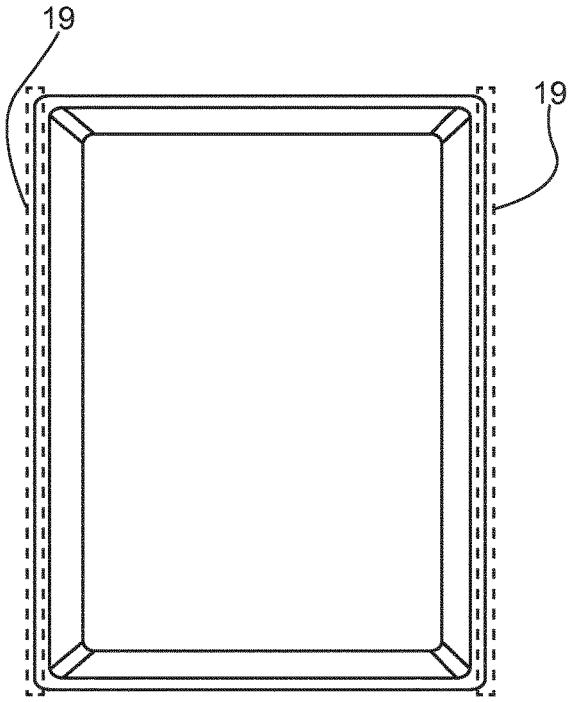
FIGS. 5 and 6 illustrates two possible configurations of containers for insertion into a drawer frame.
Figure 6:
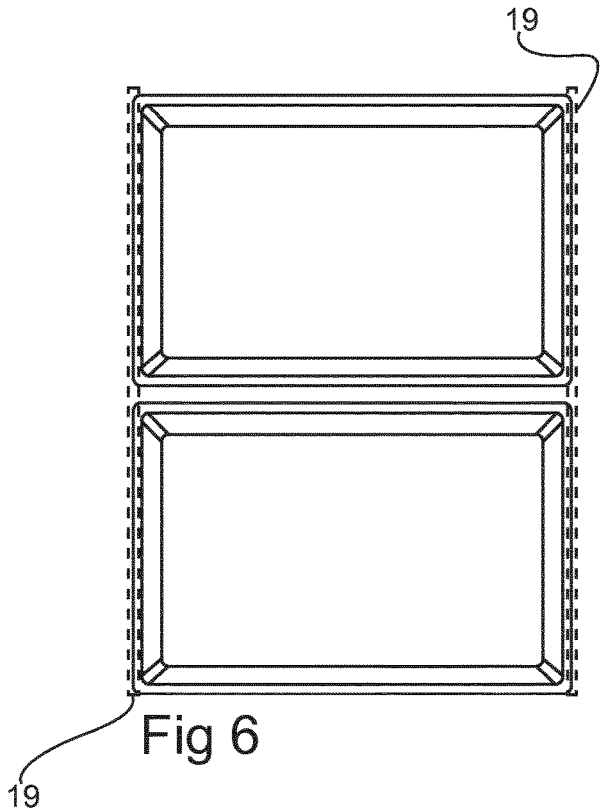

FIGS. 5 and 6 illustrates two possible configurations of containers for insertion into a rack. In FIG. 5, the box takes up the full space between two guides and the flanges, indicated with the dashed boxes, of the long edges should be left at least partially free as mentioned above.

In FIG. 6, two smaller boxes are inserted between similar guides instead. In this case, the short edges should be left at least partially free. In general thus, the lid should leave an outer portion of the flanges free along the entire length of the walls of one pair of opposing walls, specifically the flanges intended to engage with guides of a drawer frame.

Figure 7:
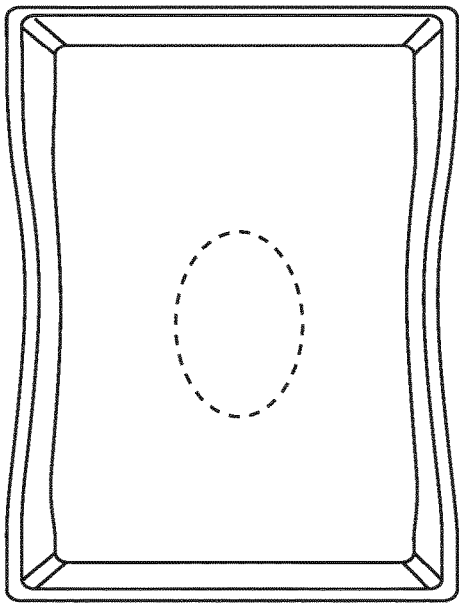
FIG. 7 shows a suspended box with a heavy load.

The stiffness of the flanges is one important determining factor for the load that can be applied in the box without the box deforming in such a way that it for instance may become stuck in a drawer frame. Such a situation is illustrated in FIG. 7, where a too heavy load (indicated dashed) makes the box bulge when suspended between the flanges of the long sides. As described above the lid design allows the flange to take up most of the inner space of the guide, which provides a stiffer flange. This may be used in combination with the reinforcing flange design to be described later, although this is not necessary.

Figure 8:
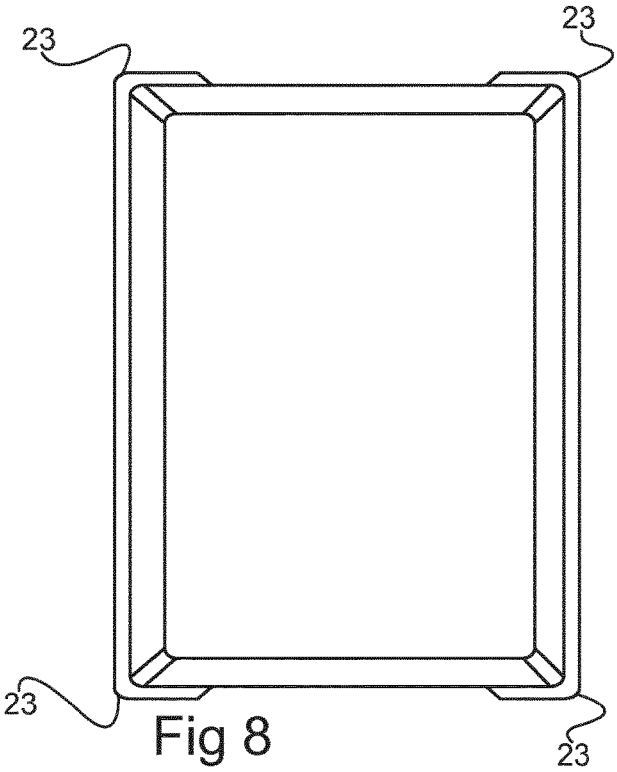
FIG. 8 illustrates a version of the container with flanges extending over a part of the periphery.

FIG. 8 illustrates a version of the box with flanges extending only over a part of the periphery. In the illustrated case, the box is intended to be suspended from flanges on its long sides. Even if in most other shown embodiments the flange extend along all four sides of the box, it may be sufficient, as illustrated that the flange extends around the corners 23 of the box, and some distance into the adjacent (in this case short) side.

Figure 10:
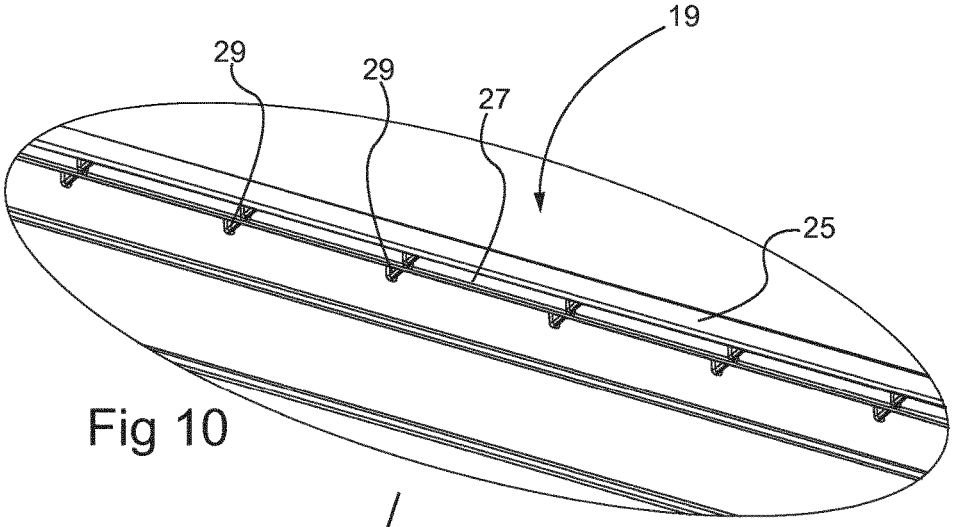
FIGS. 10 and 11 show enlarged portions of the container in FIG. 9.
Figure 9:
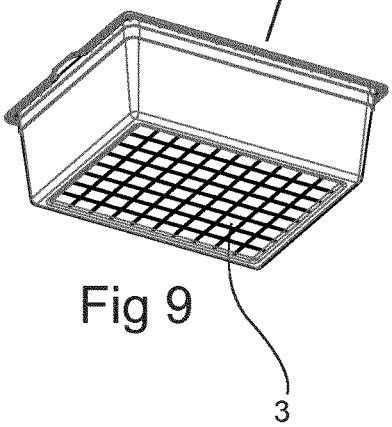
FIG. 9 shows a perspective view of the bottom of a container.
Figure 11:
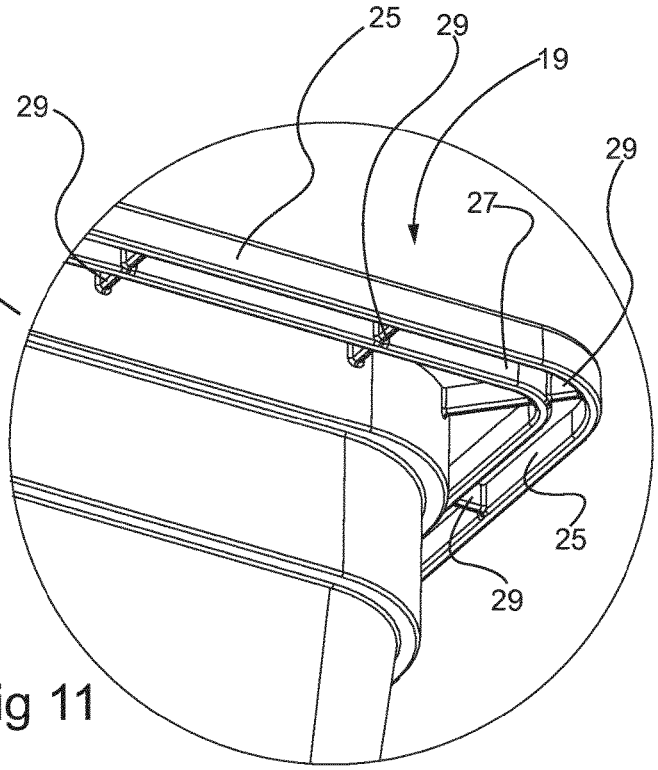

FIG. 9 shows a perspective view of the bottom of a container. As is further shown in enlarged portions in FIGS. 10 and 11 the flanges may comprise at least one reinforcing subflange 25, that extends from the flange along at least a part thereof, and is directed downwards, i.e. substantially perpendicularly towards the plane in which the bottom portion 3 extends. In the illustrated case, there are two parallel subflanges, one outer 25 and one inner 27 flange. In a typical case, the subflanges may extend about 4.2 mm from the lower surface of the main flange 19. Further, there are provided lateral reinforcement flanges 29 running perpendicularly to the reinforcement flanges, and connecting the reinforcement flanges 25, 27 to each other and to the adjacent wall of the box. Such lateral flanges may be provided at regular intervals over the sides of the box, and also at the corners of the box as shown in FIG. 11.

Figure 12:
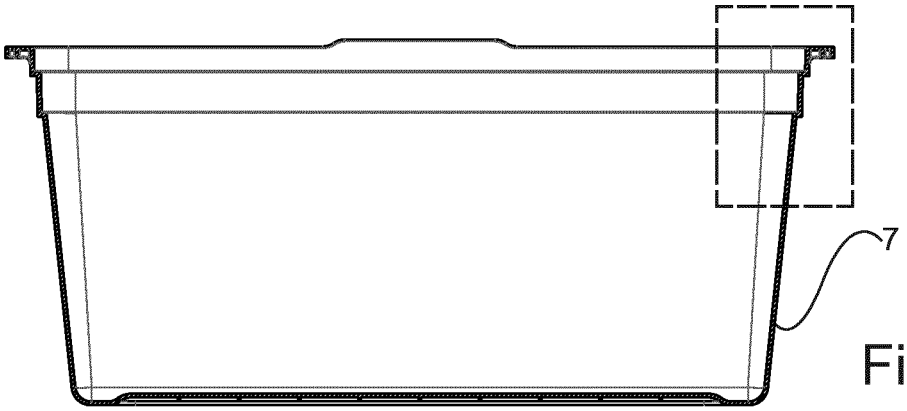
FIG. 12 shows a cross section through a container.
Figure 13:
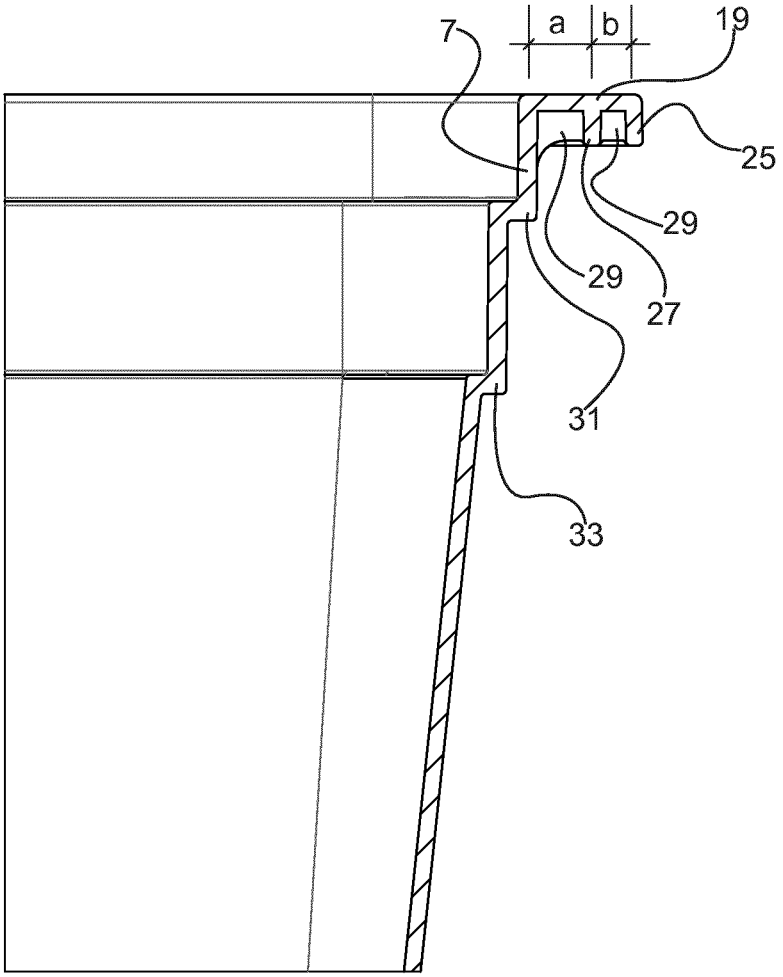
FIG. 13 shows an enlarged portion thereof.

This configuration per se provides a substantially improved strength, and will be further discussed with reference to the cross sections in FIG. 12 and FIG. 13 which show a cross section through the long sides of a box without a lid. In FIG. 12 there is shown a cross section transverse through the long side of the box, and FIG. 13 shows an enlarged portion, where the flange 19 meets the side wall 7 of the box. FIG. 13 illustrates how a strong flange may be achieved without providing a thick portions in the box. Thick goods would require substantial periods of time to become fully solid during injection molding and would therefore imply long cycle times during production. The disclosed flange configuration however, becomes very strong without using goods thicknesses exceeding 3.5 mm, even 2.0 mm could be sufficient in many applications.

The c-c (centre-centre) distance a+b, in the illustrated case, between the box wall 7 and the outer reinforcement flange 25 is about 13 mm. The distance a between the box wall 7 and the inner reinforcement flange 27 is about 8 mm. Thus, the inner reinforcement flange 27 is placed closer to the outer reinforcement flange 25 than to the box wall 7. This has proven to avoid the condition illustrated in FIG. 7 to a great extent by providing a stiffer flange. Expressed differently, the ratio (a+b)/a between the sum of the c-c distance a between the wall 7 and the inner flange 27 and the c-c distance b between the inner reinforcement flange 27 and the outer reinforcement flange 25 to the distance a is in the range between 1.5 and 1.9. In this illustrated case, the ratio is about 1.6 to 1.7, and this is considered suitable for many applications.

As further shown in FIG. 13, ledges 31, 33 may be provided in the wall 7, which make the container even stiffer and facilitates nesting of empty containers.

It should be noted that the above outlined configuration with one or more subflanges provides as such improved structural strength to a plastic container, making it more suitable for being suspended in a drawer frame. This advantage is obtained whether or not a lid of the type described earlier is used, or whether or not any lid is used at all.

The present disclosure thus considers a plastic box with a bottom portion and first and second pairs of opposing walls rising from the bottom portion where at least each of the upper edges of the first pair of walls comprise a respective flange that extend outwards in a direction substantially parallel with a plane in which the bottom portion extends, and wherein each flange comprises at least one reinforcing subflange, extending from the flange along at least a part thereof, and being directed towards a plane in which the bottom portion extends.

Typically, each main flange comprises two parallel subflanges and a plurality of lateral reinforcement flanges running perpendicularly to the subflanges and connecting the subflanges to each other and to the walls of the box, and as mentioned above, the aforementioned ratio (a+b)/a may be in the range between 1.5 and 1.9.

The present disclosure is not limited to the examples described above, and may be varied and altered in different ways within the scope of the appended claims.

What is claimed is:

1. A storage system comprising:

a box including:

a base;

a first sidewall extending at an angle from the base to a first sidewall upper edge;

a second sidewall extending at an angle from the base to a second sidewall upper edge, the second sidewall opposing the first sidewall to define a storage space;

a first flange portion extending outwardly from the first sidewall upper edge and disposed substantially in parallel with the base; and a second flange portion extending from the second sidewall upper edge and disposed substantially in parallel with the base;

a lid adapted to be supported by the first and second sidewall upper edges such that an engagement portion of each of the first and second flange portions is free along a substantial length of the first and second sidewall upper edges; and a support frame including first and second opposing guides adapted to selectively receive a corresponding one of the engagement portions of the first and second flange portions of the box;

wherein the box further comprises:

a first inner subflange and a first outer subflange extending at an angle from the first flange portion towards the base, the first inner subflange spaced at a first distance from the first sidewall and the first outer subflange disposed substantially in parallel with the first inner subflange and spaced at a second distance from the first inner subflange; and a second inner subflange and a second outer subflange extending at an angle from the second flange portion towards the base, the second inner subflange spaced at the first distance from the second sidewall and the second outer subflange disposed substantially in parallel with the second inner subflange and spaced at the second distance from the second inner subflange.

2. The storage system of claim 1, further comprising:

a first plurality of lateral subflanges extending between the first inner flange and the first sidewall;

a second plurality of lateral subflanges extending between the first inner flange and the first outer subflange;

a third plurality of lateral subflanges extending between the second inner subflange and the second sidewall; and a fourth plurality of lateral subflanges extending between the second inner flange and the second outer subflange.

3. The storage system of claim 1, wherein the first and second distances are center-to-center distances and a ratio of the sum of the first and second distances to the first distance is in a range of substantially 1.5 to substantially 1.9.

4. The storage system of claim 1, wherein the box has a length defined by the first and second sidewalls and a width, the length and being greater than the width.

5. The storage system of claim 1, wherein the box has a width defined by the first and second sidewalls and a length, the width being smaller than the length.

6. The storage system of claim 1, wherein the box and the lid are formed of solid plastic for minimizing diffusion when the box and the lid are engaged.

7. The storage system of claim 1, wherein each of the first and second guides comprises a pair of substantially parallel walls spaced by a distance and a thickness of the engagement portion of each of the first and second flanges substantially spans the distance when the engagement portion of the first and second flanges are received within the first and second guides.

8. The storage system of claim 1, wherein the box and the lid are formed from plastic.

* * * * *